United States Patent [19]

Koskinen et al.

[11] Patent Number: 4,502,171

[45] Date of Patent: Mar. 5, 1985

[54] PROCEDURE FOR WASHING CELLULOSE

[75] Inventors: Ensio Koskinen; Erkki Yli-Vakkuri, both of Savonlinna, Finland

[73] Assignee: Enso-Gutzeit Oy, Helsinki, Finland

[21] Appl. No.: 520,168

[22] Filed: Aug. 4, 1983

[30] Foreign Application Priority Data

Aug. 6, 1982 [FI] Finland ..... 822736

[51] Int. Cl.[3] ..... D21C 9/06

[52] U.S. Cl. ..... 8/156; 68/181 R; 68/184; 162/60; 210/404

[58] Field of Search ..... 8/156; 68/158, 181 R, 68/184, 205 R; 210/402, 404; 162/60, 380

[56] References Cited

U.S. PATENT DOCUMENTS

| | | | |
|---|---|---|---|
| 2,500,056 | 3/1950 | Barr | 210/402 X |
| 3,363,774 | 1/1968 | Luthi | 210/404 |
| 4,266,413 | 5/1981 | Yli-Vakkuri | 68/181 R X |
| 4,292,123 | 9/1981 | Lintunen et al. | 68/181 R X |

*Primary Examiner*—Philip R. Coe

*Attorney, Agent, or Firm*—Toren, McGeady and Stanger

[57] ABSTRACT

In a procedure for washing cellulose in a drum a continuous web is conducted through a plurality of mutually separated washing zones and in the procedure the pure washing liquid is introduced at the washing step which is last in the direction of travel of the web. This liquid displaces suspension fluid contained in the web and the latter is urged with the aid of a drained fluid pipe system to a washing step located upstream in the web's direction of travel and the displaced suspension fluid repeats the displacement washing process performed by the pure washing liquid in the last washing step. This procedure is repeated until each washing step has received a flow of washing liquid. To utilize the concentration raising capacity of the washing procedure and apparatus, before discharging the pulp, part of the drained fluid pipe system is emptied and the drained fluid therefrom obtained is returned to an earlier washing step.

4 Claims, 1 Drawing Figure

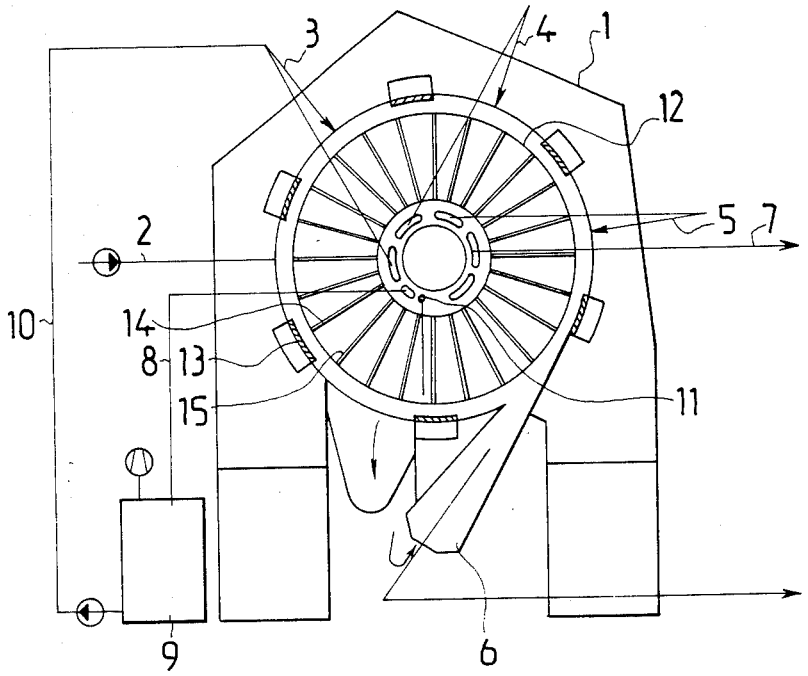
3
4
1
12
5
7
2
10
14
8
13
15
11
9
6

PROCEDURE FOR WASHING CELLULOSE

The present invention concerns a procedure for washing cellulose in a drum in a manner known on itself in the art, in which procedure a continuous web is conducted through a plurality of washing zones isolated from one another and in which, in the last washing step in the travelling direction of the web, the pure washing liquid is introduced which displaces suspension fluid contained in the web, which fluid is by the aid of a drained fluid pipe system urged to a washing step earlier in the travelling direction of the web, where said suspension fluid repeats the displacement washing effected by the pure washing liquid at the last washing step, this being repeated until all washing steps have been gone through.

The most common procedure of washing cellulose is to use three or four drums provided with a wire fabric and constituting a washing line, at the beginning of which the cellulose to be washed is introduced at a dry matter content about 1%. The washing takes place by flushing upon each drum, whereafter the cellulose is conducted into the basin of the next drum and the liquid that has passed through the wire is transferred to serve as cleaning water at the preceding washing step. In the basins of the drums, the cellulose is diluted again to be consistent with the original dilution; not until after having ascended onto the drum of the last step is it collected without being diluted after the washing. The dry matter content that can be obtained is on the order of 13 to 15%.

This method is old and traditional and requires ample space and plenty of energy because of the complicated matter transporting system. Through the Finnish Pat. No. 56865 is known a newer and more expedient procedure. Therein, the cellulose is washed as a continuous web in that the web being formed in a separate concentration zone is treated in a washing zone comprising 2 to 6 washing steps and in which the washing takes place according to the countercurrent principle by introducing the pressurized pure washing liquid only in the last washing step, in the direction of travel of the web, and which as it percolates through the web displaces therein the equivalent quantity of the suspension liquid; this latter, being subject to the pressure of the pure washing liquid throughout the process, in its turn displacing suspension liquid from the portion of the pulp web which is in the penultimate washing step and which proceeds to the next washing step. By this procedure, about 10% concentration is reached in the washed pulp.

However, this procedure is encumbered by certain drawbacks. The drained fluid passing through the pulp cake after the last washing step goes back into the pulp cake as of that part which is in the drained fluid pipe system. Thereby the returning liquid impairs the result of washing. The concentration of the washed pulp should also be as high as possible, for instance with a view to reducing the evaporating costs. The object of the present invention is to carry out emptying of the drained fluid pipe system before pulp removal and thereby to improve the result of the washing and to increase the end concentration of the pulp. The procedure of the invention is characterized in that before discharging the pulp, part of the drained fluid pipe system is emptied and the drained fluid gathered therefrom is returned to an earlier washing step.

An advantageous embodiment of the invention is characterized in that the emptying of the drained fluid pipe system is carried out by draining one pipe at a time through a distribution valve on the end of the drum after the last washing step with subatmospheric pressure (vacuum). Hereby no extra piping or valves are required for the emptying process.

An advantageous embodiment of the invention is also characterized in that at the emptying point of the drained fluid pipes there is more than one pipe under effect of vacuum. This implies that each pipe arriving at the emptying point will be emptied of drained fluid and will thereafter be subject to vacuum effect for a further brief period. Hereby, the vacuum will dry the pulp cake in some of the pipes simultaneously as it drains, one at a time, new pipes arriving at the draining point.

An advantageous embodiment of the invention is further characterized in that the drained fluid is collected in a separate drained fluid tank wherefrom it is returned by the aid of a pump to the drained fluid feed of an earlier washing step. In this manner, the washing liquid is recovered. The pulp cake may now be detached e.g. with the aid of compressed air conducted into the drained fluid pipes through said distribution valve.

The invention is described in the following by the aid of an example by referring to the drawing attached, which schematically presents an apparatus for washing cellulose provided with an ultimate concentrator arrangement as taught by the invention.

In the FIGURE, the pressure washer 1 has been represented with four arrows 2, 3, 4, 5 representing the flow of the washing liquid. The pure washing liquid is introduced at the point indicated by the arrow 2, that is, in the last washing step. The arrows 3, 4 and 5 show the circulation of the washing liquid through the washing steps. The pulp supply is at point 6, and the escaping fluid drained in the washing process is indicated by the arrow 7. A means of this kind is previously known for instance through the Finnish Pat. No. 56564.

When the washing has proceeded to the step in which the pulp is detached, at point 13 each drained fluid pipe 14 from the fourth washing step is sucked empty of drained fluid with the aid of vacuum through the pipe 8 into the tank 9, whence the drained fluid is returned by the pipe 10 to the third, i.e. the penultimate, washing step, as shown by the arrow 3. This emptying concluded, the pulp web is removed by blowing, in a manner known in itself, compressed air into one of the drained fluid pipes 15 that has passed the point 13, through a connector 11. The point 13 is a component of the washer, its task and structural design being known e.g. through the Finnish Pat. No. 56564.

This emptying of the drained fluid pipe and circulating of the drained fluid recurs as a continuous process and requires no machinery shut-down or other extra measures, at least not in the case of the comparatively slow-running cellulose washing apparatus concerned here. Therefore, in the manner introduced in the foregoing, the result of washing can be substantially improved and the end concentration of the pulp cake can be increased even up to 15%.

It is obvious to a person skilled in the art that various embodiments of the invention are not exclusively confined to the example presented above and that they may instead vary within the scope of the claims stated below.

We claim:

1. Improvement in a procedure for washing cellulose on a drum comprising the steps of conducting a continuous pulp web along a path of travel through a plurality of mutually separated washing zones located one after the other on the drum with the pulp web containing fluid as it moves through the washing zones, introducing pure washing liquid into the last washing zone in the path of travel of the pulp web on the drum, displacing the suspension fluid contained in the web in the last washing zone by the introduction of the pure washing liquid, providing a drained fluid pipe system on the drum and using the drained fluid pipe system for directing the displaced suspension fluid from the last washing zone to another washing zone upstream in the path of travel from the last washing zone, introducing the displaced suspension fluid from the last washing zone in the another washing zone for displacing the suspension fluid in the web in the another washing zone, repeating the introducing and displacing steps each time into an upstream washing zone from the washing zone where the displacing step is performed until the displaced suspension fluid has been introduced into each washing zone upstream from the last washing zone, wherein the improvement comprises before discharging the pulp web from the drum after the pulp web has traversed the last washing zone, emptying part of the fluid from the drained fluid pipe system at a location downstream from the last washing zone and returning the drained fluid therefrom to a washing zone upstream from the last washing zone.

2. Improvement in a procedure according to claim 1, wherein the step of emptying part of the fluid from the drained fluid pipe system includes emptying one pipe at a time through a distribution valve located on the end of the drum with the aid of a vacuum.

3. Improvement in a procedure according to claim 2, wherein at the location of emptying the drained fluid pipe system placing more than one pipe of the drained fluid pipe system under the effect of the vacuum.

4. Improvement in a procedure according to claim 1, including the step of collecting the drained fluid from the drained fluid pipe system in a separate drained fluid tank and using a pump for conveying the drained fluid to the upstream washing zone.

* * * * *